US005133667A

United States Patent [19]

Daughtrey

[11] Patent Number: 5,133,667

[45] Date of Patent: Jul. 28, 1992

[54] FLEXIBLE CIRCUIT CONNECTOR

[75] Inventor: Stuart P. Daughtrey, Richmond, Canada

[73] Assignee: Digital Equipment Corporation, Maynard, Mass.

[21] Appl. No.: 718,498

[22] Filed: Jun. 20, 1991

[51] Int. Cl.[5] ..... H01R 9/09

[52] U.S. Cl. ..... 439/67; 439/378; 439/496

[58] Field of Search ..... 439/67, 77, 329, 62, 439/493, 495, 496, 378

[56] References Cited

U.S. PATENT DOCUMENTS

| | | | |
|---|---|---|---|
| 3,065,446 | 11/1962 | Robb et al. | 439/496 |
| 4,693,529 | 9/1987 | Stillie | 439/67 |
| 4,693,530 | 9/1987 | Stillie et al. | 439/67 |
| 4,717,345 | 1/1988 | Gordon et al. | 439/67 |
| 4,798,541 | 6/1989 | Porter | 439/67 |
| 4,834,660 | 5/1989 | Cotti | 439/67 |
| 4,871,315 | 10/1989 | Noschese | 439/67 |
| 4,911,643 | 3/1990 | Perry et al. | 439/67 |
| 4,913,656 | 4/1990 | Gordon et al. | 439/67 |
| 5,044,980 | 3/1991 | Krumme et al. | 439/67 |

*Primary Examiner*—Neil Abrams
*Attorney, Agent, or Firm*—Ronald E. Myrick; Barry N. Young; Ronald C. Hudgens

[57] ABSTRACT

An electrical connector serves to connect first and second opposed flex circuits. A female member supports a second of the flex circuits formed with a plurality of raised contact features. A male member supports a first of the flex circuits formed with a plurality of contact pads. A resilient pad received in a cavity in the surface of the female member underlies the second flex circuit and biases the raised contact features away from the female member. The male member is movable in a forward direction from a first position whereat the contact feature and the contact pad are disengaged through a second position whereat the contact feature and the contact pad are initially engaged at a first location to a third position compressing the resilient pad toward said female member. Surfaces of the male and female member supporting the contact pad and contact feature, respectively, are parallel and angularly disposed relative to the direction of movement of the male member whereby the contact feature is wiped across the contact pad from the first location to a second location spaced from the first location as the male member moves from the second position to the third position. In a preferred construction, the male surface is v-shaped, including first and second branches which meet along a ridge and the female surface is similarly v-shaped, including first and second branches which meet along a groove.

13 Claims, 3 Drawing Sheets

FLEXIBLE CIRCUIT CONNECTOR

BACKGROUND OF THE INVENTION

1. Field of the Invention

The present invention relates generally to flexible circuit connectors and, more particularly, to high density connectors of that type which apply a progressive contact wiping action as the mating members are moved toward closure.

2. Description of the Prior Art

The present invention is an improvement resulting from a continuing investigation of the potential application of flexible circuit technology as a solution to high density interconnect with enhanced electrical characteristics. As is customary in the art, the term "flex circuit" and its derivations will hereinafter be used in place of the term "flexible circuit" and its derivations.

The increasing demand for higher speeds in digital processing is dictating requirements for card edge connectors that currently cannot be met by commercially available components in terms of I/O density and electrical signal integrity. Conventional connectors using metal pin and spring beam contacts cannot easily be miniaturized to satisfy the anticipated pin count densities for future high performance computers and the inherent electrical characteristics cannot be readily adjusted to meet requirements in terms of propagation delay, risetime degradation, reflection and crosstalk.

The inherent features of flex circuit technology and its artwork driven manufacture permits the custom design of signal line characteristics. The ability to manufacture this material to precise tolerances with mechanically formed or photo-etched contact features makes it an ideal component on which to base the design of a state-of-the-art high performance connector.

Typically of known but recent connection constructions between flex circuits effected in a non-wiping fashion is U.S. Pat. No. 4,913,656 to Gordon et al. Another recent construction is disclosed in U.S. Pat. No. 4,911,643 to Perry et al. which provides a high density connector having a spring element in the form of an elongated hollow split tube with a heat-recoverable member of shape-memory alloy positioned within the tube. First and second sets of parallel spaced conductors terminate at least at one end of the tube in a first and second matrix of contact pads, the matrices and the pads being positioned within the split. A change in temperature changes the shape-memory alloy from one metallurgical state to another, causing movement of the heat-recoverable member and the spring means to open and close the connector.

Flexible circuit connectors or the like which employ elastomer or resilient members to increase contact pressure are disclosed, for example, in U.S. Pat. No. 4,834,660 to Cotti; U.S. Pat. No. 4,798,541 to Porter; U.S. Pat. No. 4,717,345 to Gordon et al; U.S. Pat. No. 4,693,530 to Stillie et al; and U.S. Pat. No. 4,693,529 to Stillie. Of these, Gordon et al. '345 and Cotti '660 disclose resilient members which provide contact wiping action. Also, in a number of the embodiments disclosed in the Gordon et al. '345 patent, alignment pins are employed to retain the relative relationship of the mating contact supports as they are moved between withdrawn and engaged positions. A circuit connector for joining flexible circuits to a PCB which applies a wiping action as connection is begun, then completed, is disclosed in U.S. Pat. No. 4,871,315 to Noschese.

U.S. Pat. No. 2,869,043 to Locher discloses connector having an alignment pin which simultaneously aligns the mating components and serves as an electrical conductor.

It was with knowledge of the state of the art as exemplified by the foregoing patents that the present invention has been conceived and is now reduced to practice.

SUMMARY OF THE INVENTION

According to the invention, an electrical connector serves to connect first and second opposed flex circuits. A female member supports a second of the flex circuits formed with a plurality of raised contact features. A male member supports a first of the flex circuits formed with a plurality of contact pads. A resilient pad received in a cavity in the surface of the female member underlies the second flex circuit and biases the raised contact features away from the female member. The male member is movable in a forward direction from a first position whereat the contact feature and the contact pad are disengaged through a second position whereat the contact feature and the contact pad are initially engaged at a first location to a third position compressing the resilient pad toward said female member. Surfaces of the male and female member supporting the contact pad and contact feature, respectively, are parallel and angularly disposed relative to the direction of movement of the male member whereby the contact feature is wiped across the contact pad from a first location to a second location spaced from the first location as the male member moves from the second position to the third position.

In a preferred construction, the male surface is v-shaped, including first and second branches joined along a ridge and the female surface is similarly v-shaped, including first and second branches joined along a groove. The respective branches of the male surface are parallel to those of the female surface and the ridge and the groove are in a contiguous relationship when the male member is in the third position. Alignment pins on the male member are slidably engaged with mating alignment holes in the female member to maintain a proper relationship at all times between the male and female surfaces.

One of the more unique features of this connector arrangement is the manner in which it introduces wipe. Specifically, each raised contact feature is slid along the face of its mating pad during the process of applying normal force. This is a highly desirable feature in that it allows the contact interface to break through contaminants or displace debris that might reside at either of the contact interfaces when they are mated and thereby significantly improve the reliability of the electrical connection.

Another feature of the invention is that the wipe is performed progressively as the normal force is increased. Yet a further feature is that the amount of wipe, the wipe distance, can be adjusted by changing the throat angle of the connector. Not the least of the features of the invention is that by altering the thickness and/or hardness of the resilient pad, a wide range of contact normal force is obtainable.

The electrical connector of the invention is of simplified design having a minimum of parts. Key mechanical components can be molded or are standard hardware. The connector can be scaled for higher contact densities and its design is based on known flex circuit technologies including controlled impedance characteristics.

The alignment precision required at the separable interconnect is embodied in the connector and is, therefore, removed from the back plane and the module themselves.

Yet another benefit of the invention is the design of the connector by reason of which power can be transmitted through the alignment pins and their mating sockets used to align the connector on the backplane.

Other and further features, advantages, and benefits of the invention will become apparent in the following description taken in conjunction with the following drawings. It is to be understood that the foregoing general description and the following detail description are exemplary and explanatory but are not to be restrictive of the invention. The accompanying drawings which are incorporated in and constitute a part of this invention, illustrate one of the embodiments of the invention and together with the description, serve to explain the principles of the invention in general terms. Like numerals refer to like parts throughout the disclosure.

DETAILED DESCRIPTION OF THE PREFERRED EMBODIMENT

Figure 1:
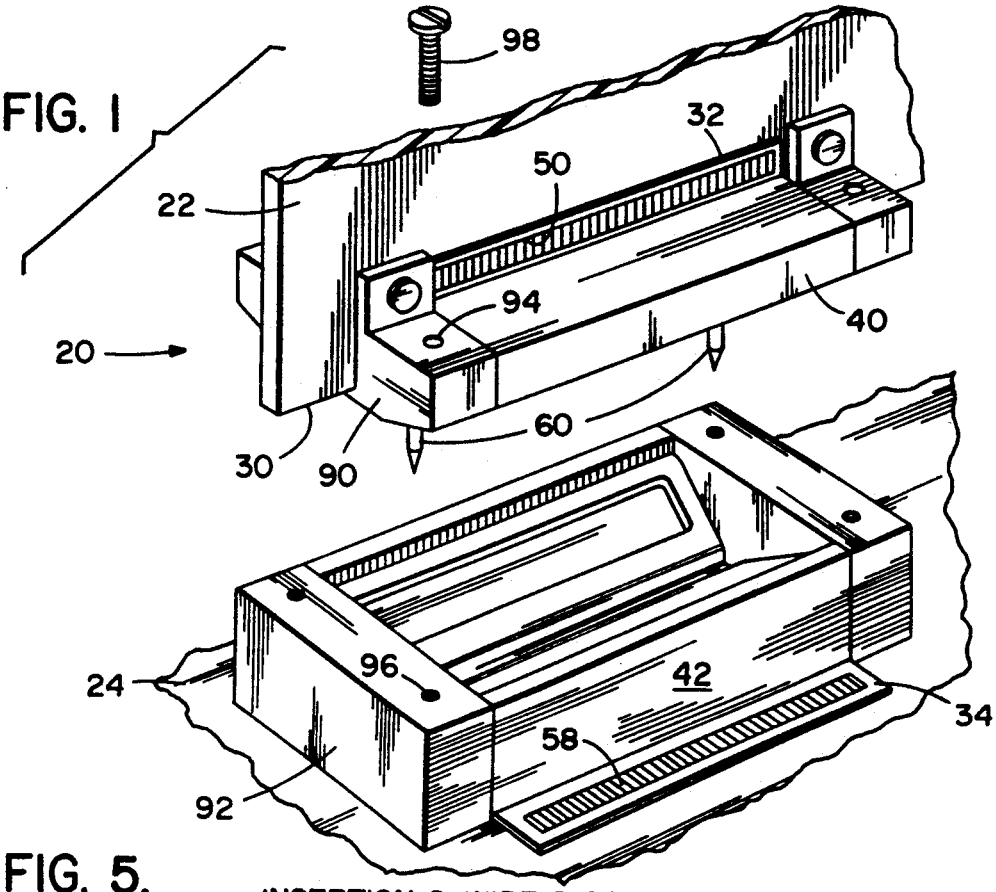
FIG. 1 is an exploded perspective view generally illustrating an application of the electrical connector embodying the present invention.

Turn now to the drawings, and initially, to FIG. 1 which illustrates a flex circuit connector 20 embodying the present invention. The connector is intended for use by electronic circuit designers and electronic packaging specialists to provide a high density, that is, 160 contacts per inch or greater, separable interconnection between a circuit module 22 and a backplane 24. The connector 20 is focused on potential applications that cannot currently be met by commercially available connectors due to contact density requirements and/or electrical characteristics.

Figure 2:
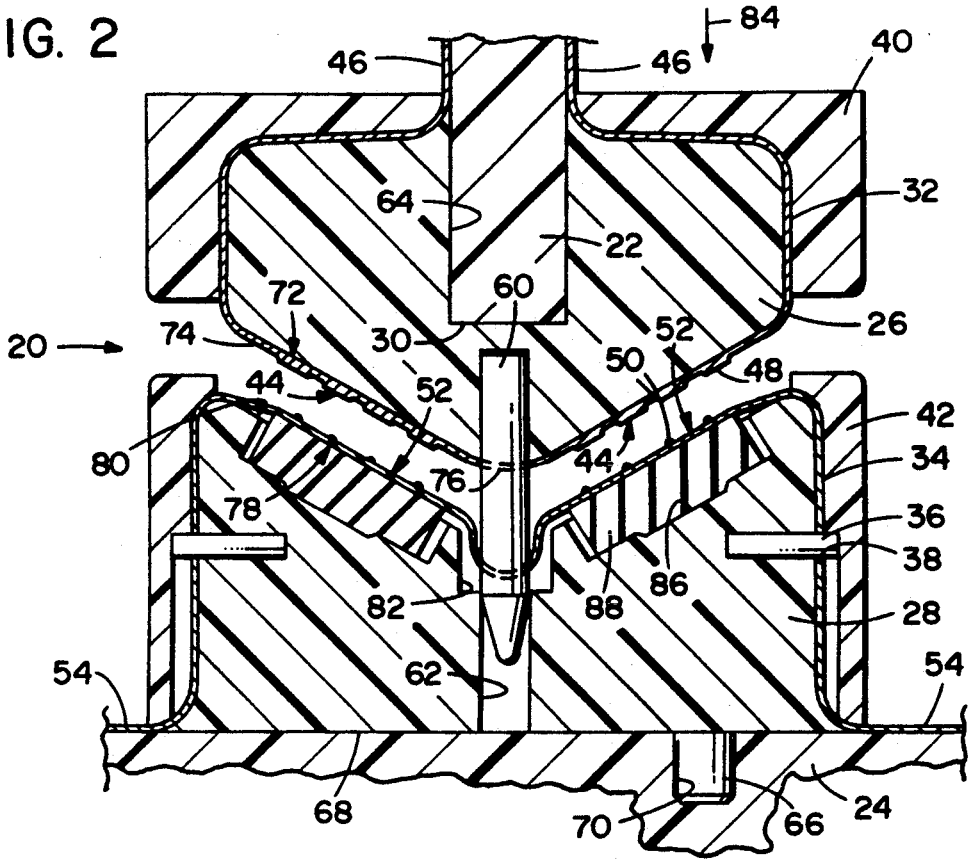
FIG. 2 and 3 are cross section views, in elevation, illustrating, respectively, a disengaged position and a fully engaged position of the connector of the invention.
Figure 3:
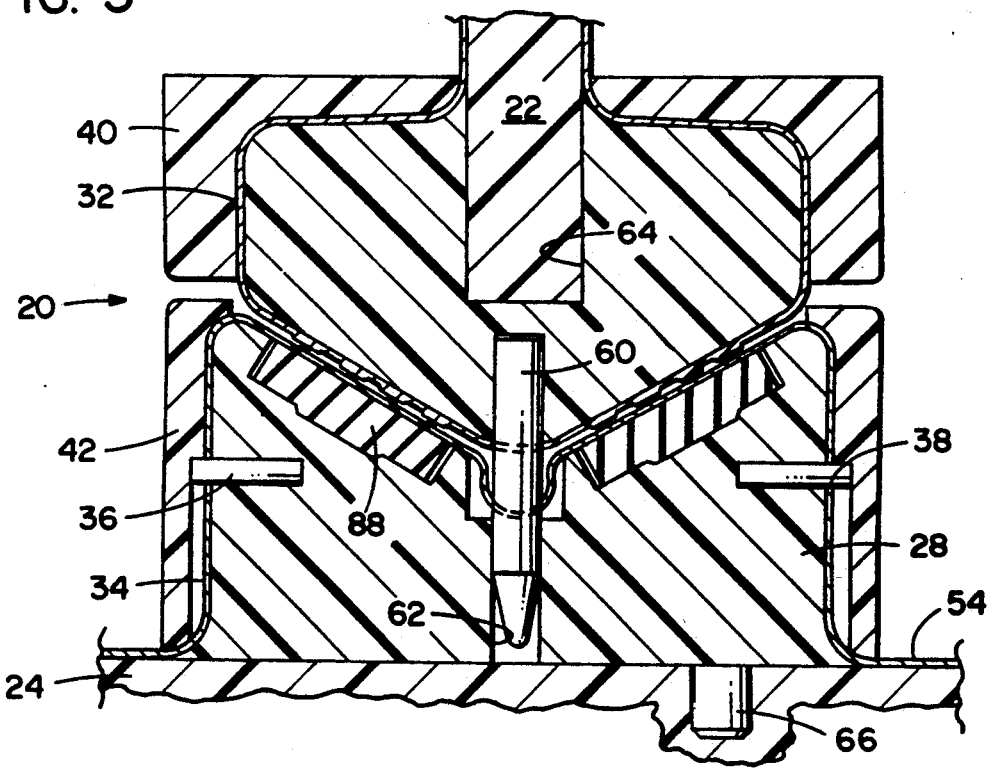

With continuing reference to FIG. 1 and turning also to FIGS. 2 and 3, an upper or male half of the connector 20 is generally denoted by reference numeral 26 and a lower or female half of the connector is generally denoted by reference numeral 28. One or more of the male members 26 are mounted to a connecting edge 30 of a printed circuit card or module 22 and, similarly one or more of the female members 28 are mounted to the backplane circuit card 24 and aligned to mate with its male component on the module.

Both the male member 26 and the female member 28 are comprised of a plastic body on which a flex circuit 32 and 34, respectively, is mounted. Both flex circuits 32, 34, are aligned to their respective member 26, 28 by means of suitable alignment pins. One example illustrated is alignment pin 36 in the female member 28 which mates with an alignment aperture 38 in the flex circuit. Although not shown, a similar arrangement may be provided to properly locate the flex circuit 32 on the male member 26. The flex circuits 32, 34 are held in a contiguous relationship with the outer surface of the male and female members 26, 28 by means of suitable cover plates 40, 42, respectively.

As seen most clearly in FIGS. 2 and 3, flex circuit 32 incorporates a pair of contact areas 44 and a pair of bonding areas 46 with signal line traces running from individual contact sites in the form of contact pads 48 to a bond window 50 (FIG. 1.) Similarly, the flex circuit 34 incorporates two contact areas 52 and two bonding areas 54 with signal line traces running from individual contact sites, or raised contact features 56 (FIG. 2), to bond windows 58 (FIG. 1). When the two halves, that is, male member 26 and female 28, of the flex circuit connector 20 are aligned and mated, each raised contact feature 56 on the flex circuit 34 mates with a corresponding flat pad 48 on the adjacent flex circuit 32.

With continued reference to FIGS. 2 and 3, male member 26 is provided with at least a pair of downwardly projecting alignment pins 60 mounted at longitudinally spaced locations for slidable reception with mating alignment holes 62 formed in the female member 28. Alignment pins 60 and associated alignment holes 62 assure that throughout movement of the male member 26 from a withdrawn position as depicted in FIG. 2 to a fully connected position as illustrated in FIG. 3, the contact areas 44 and 52 will be properly aligned and, particularly, the contact pads 48 with their associated raised contact features 56. It will be appreciated, also, that a longitudinal slot 64 in the upper regions of the male member 26 serves to receive and position the lower portions of the circuit module 22. Also, a pair of spaced apart mounting pins 66 extending from an underside 68 of the female member 28 similarly mate with associated holes 70 in the back plane 24.

The male member 26 is formed with a v-shaped male surface 72 which includes first and second branches 74 which meet along a ridge 76. In similar fashion, the female member 28 is formed with a surface 78 which is also v-shaped and includes first and second branches 80 meeting along a central, longitudinally extending, groove 82. The groove is provided to accommodate a small amount of flex circuit translation during the connector mating process. As seen in FIG. 3, the ridge 76 and the groove 82 are in a substantially contiguous relationship when the connector 20 is in the closed or fully mated condition as illustrated in FIG. 3. The mutually facing branches 74 of the male member 26 and 80 of the female member 28 lie in parallel planes and are equiangularly disposed relative to the direction of movement of the male member relative to the female member as indicated by an arrow 84.

The female surface 78 is provided with a cavity 86 in each branch 80 and an elastomeric pad 88 is inset into each of the cavities. Each elastomeric pad is positioned beneath a contact area 52 on the flex circuit 34. The thickness of the elastomeric pad 88 is greater than the depth of the cavity 86 such that the contact area 52 is held above the female surface 78. However, when the male and female members 26, 28 are clamped together, the elastomer is compressed to the extent indicated in FIG. 3 at which the upper surface of the pad lies substantially in the plane of the female surface 78. It will be appreciated that by altering the thickness and/or the hardness of the elastomeric pads, a wide range of contact normal forces, that is force applied in a direction perpendicular to the upper surface of the elastomeric pad, is attainable.

Suitable integral ends 90 are provided at the opposite ends of the male member 26 so as to encompass the ends of the cover plates 40 and, similarly, integral ends 92 encompass the opposite ends of the cover plates 42 and of the female members 28. Clearance holes 94 in the integral ends 90 are aligned with tapped holes 96 in the integral ends 92 such that mounting screws 98 extending through the clearance holes 94 can be threadedly engaged with the tapped holes 96 to thereby join the male and female members 26, 28 and their associated components together. Of course, other mechanical arrangements can readily be incorporated other than the screws 98 to draw the components together should that be desirable.

Figure 4:
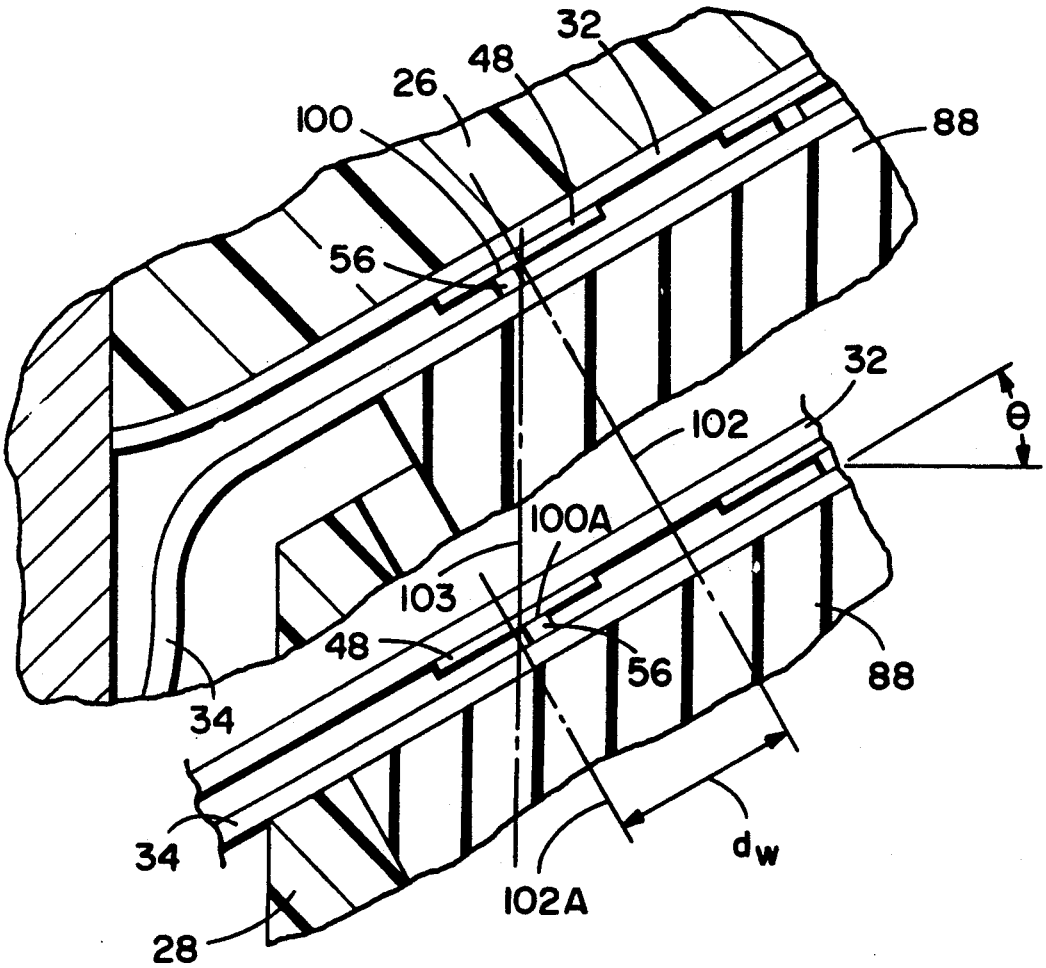
FIG. 4 is a view for illustrating the wiping action which takes place between the contact members as the male and female members of the connector move toward a fully mated position.

Turn now to FIG. 4, for an explanation of the mechanics involved in operating the flex circuit connector 20. When the mounting pins 66 on the male member 26 are inserted into the alignment holes 62 of the female member 28 and the male and female surfaces 72, 78, are moved toward one another, as by means of the screws 98, the contact pads 48 associated with the male member 26 will make mutual contact with the contact features 56 at a centralized location noted by numeral 100 in FIG. 4. This is seen in FIG. 4 as being to the left of a center line 102 of the contact pad 48. As the male member 26 is further depressed toward engagement with the female member 28, the contact pads 48 continue to move in a vertical straight line 103 toward its mating contact feature 56. However, as the contact pad 48 is inserted further into the assembly, the elastomeric pad 88 is compressed and the contact feature 56 is forced to move in a direction perpendicular to the face of the flat pad, that is, along a line parallel to the line 102 thereby imparting relative motion between the contact pad 48 and the contact feature 56. When the elastomeric pad is fully compressed, the contact feature 56 will centrally reside at a point 100A which is now to the right of the center line of contact pad 48 now moved to location 102A from its initial contact point.

The wipe distance is a function of the throat angle $\theta$, that is, the angle of inclination of the male surface 72 and of the female surface 78 relative to the direction of movement 84 of the male member 26 toward the female member 28. To demonstrate the versatility of this connector arrangement, the relationship between wipe, insertion, and elastomer compression distances and throat angle are readily presented in the relationships:

$$d_w = d_c \cos \theta;$$

and $$d_i = d_c \tan \theta,$$

where $d_w$ is the wipe distance, $d_c$ is the distance along the contact center line, and $d_i$ is the distance of insertion in the direction of the arrow 84.

Figure 5:
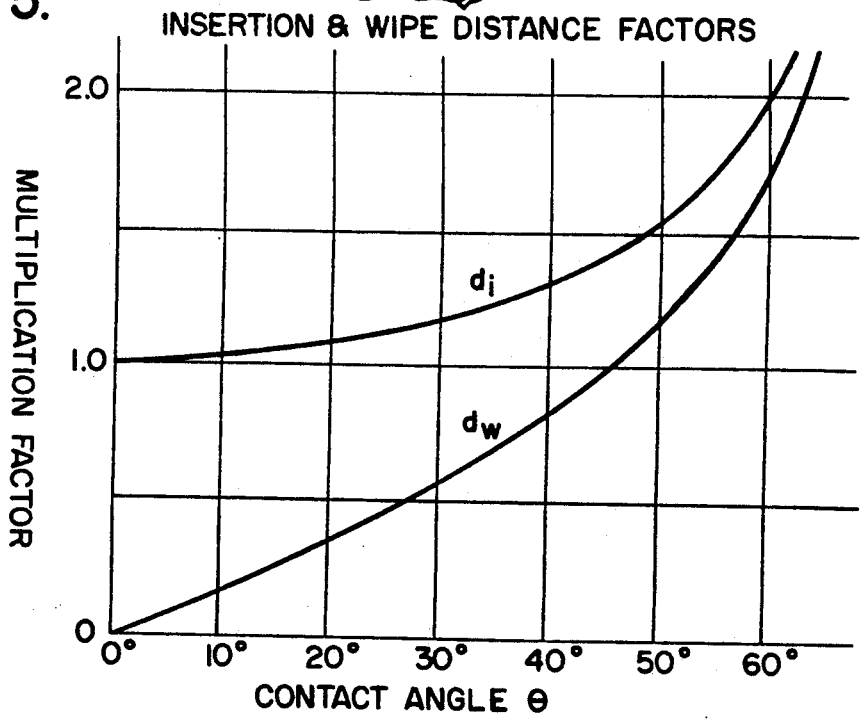
FIG. 5 is a graph depicting multiplication factor versus contact angle for typical connectors embodying the invention.

Curves have been plotted for the insertion distance and for the wipe distance as illustrated in FIG. 5 for various contact angles. The abscissa of the graph represents the compression distance multiplication factor. For any given angle $\theta$, one can obtain the insertion distance or the wipe distance by applying the appropriate multiplication factor to the elastomeric compression distance. For example, if one assumes that the compression distance, that is, the distance along line 102, is equal to 0.025 inches and a contact angle, $\theta$, is 30°, then, using FIG. 5, $d_i = 1.15\ (0.025) = 0.029$ inches; and $d_w = 0.58\ (0.025) = 0.015$ inches.

From the foregoing, it is apparent how the connector design can be readily modified to accommodate various performance requirements.

In applications requiring high density interconnect, it is anticipated that increased power will also be a requirement. An additional feature of this connector design is the potential to incorporate a separable power interconnection into each connector segment utilizing the alignment pins 60, 66 and their mating sockets 62, 70. Based on the currently proposed geometry, a current carrying capacity of 50 amperes per connector segment is considered attainable.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. An electrical connector for connecting a first flex circuit having at least one contact pad thereon and a second flex circuit having at least one raised contact feature thereon engageable with the contact pad, said electrical connector comprising:

a female member including a V-shaped female surface for the support thereon of the second flex circuit, said female surface including first and second branches which meet along a groove;

resilient means on said female member contiguously underlying the second flex circuit and biasing the raised contact feature away from said female member;

a male member including a V-shaped male surface for the contiguous support thereon of the first flex circuit, said male surface including first and second branches which meet along a ridge, said male member being movable in a forward direction from a first position whereat the contact feature and the contact pad are disengaged through a second position whereat the contact feature and the contact pad are initially engaged at a first location to a third position compressing said resilient means toward said female member, said male and said female surfaces lying in substantially parallel planes angularly disposed relative to the direction of movement of said male member whereby the contact feature is wiped across the contact pad from a first location to a second location spaced from the first location as said male member moves from said second position to said third position, said ridge and said groove being in a contiguous relationship when said male member is in said third position.

2. An electrical connector as set forth in claim 1 including guide means on said male member and on said female member mutually slidably engageable for maintaining a constant angular disposition of said male and female surfaces as said male member moves between said first position and said third position.

3. An electrical connector as set forth in claim 1 wherein said first branches and said second branches of said male and said female surfaces are equiangularly disposed relative to the forward direction of movement of said male member toward said female member.

4. An electrical connector as set forth in claim 1 wherein said female member has at least a pair of spaced apart alignment holes; and wherein said male member includes at least a pair of outwardly projecting alignment pins slidably engaged with said alignment holes for maintaining said male and female surfaces in a substantially parallel relationship as said male member moves relative to said female member between said first position and said third position.

5. An electrical connection assembly comprising:

a first flex circuit having at least one contact pad thereon;

a second flex circuit having at least one raised contact feature thereon engageable with said contact pad;

a female member including a v-shaped female surface for contiguously supporting said second flex circuit thereon, said female surface including first and second branches which meet along a groove;

resilient means on said female member contiguously underlying said second flex circuit and biasing said raised contact feature away from said female member;

a male member including a v-shaped male surface for contiguously supporting said first flex circuit thereon, said male surface including first and second branches which meet along a ridge, said male member being movable on said female member in a forward direction from a first position whereat said contact feature and said contact pad are disengaged through a second position whereat said contact feature and said contact pad are initially engaged at a first location to a third position compressing said resilient means toward said female member, said male and said female surfaces lying in substantially parallel planes angularly disposed relative to the direction of movement of said male member whereby said contact feature is wiped across said contact pad from the first location to a second location spaced from the first location as said male member moves from said second position to said third position, said ridge and said groove being in a contiguous relationship when said male member is in said third position.

6. An electrical connection assembly as set forth in claim 5 including guide means on said male member and on said female member mutually slidably engageable for maintaining a constant angular disposition of said male and female surfaces as said male member moves between said first position and said third position.

7. An electrical connection assembly as set forth in claim 5 wherein said first branches and said second branches of said male and female surfaces are equiangularly disposed relative to the forward direction of movement of said male member toward said female member.

8. An electrical connector as set forth in claim 5 wherein said female member has at least a pair of spaced apart alignment holes; and wherein said male member includes at least a pair of outwardly projecting alignment pins slidably engaged with said alignment holes for maintaining said male and female surfaces in a substantially parallel relationship as said male member moves relative to said female member between said first position and said third position.

9. An electrical connector comprising:

a female member including a female surface for supporting thereon a flex circuit having a raised contact feature thereon, said surface having a cavity therein;

resilient means on said female member underlying the flex circuit and biasing the raised contact feature away from said surface;

a male member including a male surface for supporting a contact pad thereon, said male member being movable in a forward direction from a first position whereat the contact feature and the contact pad are disengaged through a second position whereat the contact feature and the contact pad are initially engaged at a first location to a third position compressing said resilient means toward said female member, said male and said female surfaces lying in substantially parallel planes and being angularly disposed relative to the direction of movement of said male member whereby the contact feature is wiped across the contact pad from the first location to a second location spaced from the first location as said male member moves from said second position to said third position, said resilient means including an elastomeric pad received in the cavity having an outer surface normally lying in a first plane generally parallel to said female surface but spaced therefrom in the direction of said male member, said elastomeric pad underlying the raised contact feature on the flex circuit, said outer surface being movable to a second plane coplanar with said surface of said female member when said male member is moved to said third position.

10. An electrical connector as set forth in claim 9 including guide means on said male member and on said female member mutually slidably engageable for maintaining a constant angular disposition of said male and female surfaces as said male member moves between said first position and said third position.

11. An electrical connector comprising:

a first member including a first surface supporting at least a first contact thereon;

a second member including a second surface facing said first surface supporting thereon a flex circuit with at least a second contact thereon positioned for mating engagement with said first contact;

resilient means including an elastomeric pad received in a cavity formed in said second surface underlying said flex circuit, said elastomeric pad having an outer surface normally lying in a first plate generally parallel to said second surfaces but spaced therefrom in the direction of said first member, said elastomeric pad underlying the second contact on the flex circuit and biasing said flex circuit away from said second surface toward said first surface;

said first member being movable in a forward direction from a first position distant from said second member to a second position whereat said second contact lightly engages said first contact to a third position whereat said second contact firmly engages said first contact and forces said flex circuit against the bias of said resilient means into engagement with said second surface;

said first and second surfaces lying in substantially parallel planes angularly disposed relative to the forward direction of movement of said first member such that said second contact lightly engages said first contact at a first location when said first member is in said second position and such that said second contact firmly engages said first contact at a second location spaced from the first location when said first member is in said third position, said second contact being caused to wipe across said first contact as said first member moves between said second and third positions, said outer surface of said elastomeric pad being movable to a second plane coplanar with said second surface when said first member is moved to said third position.

12. An electrical connector for connecting a first flex circuit having at least one contact pad thereon and a second flex circuit having at least one raised contact feature thereon engageable with the contact pad, said electrical connector comprising:

a female member including a female surface for supporting the second flex circuit thereon, said female surface having a cavity therein;

resilient means on said female member underlying the second flex circuit and biasing the raised contact feature away from said female member;

a male member including a male surface for supporting the first flex circuit thereon, said male and female surfaces lying in substantially parallel planes, said male member being movable in a forward direction from a first position whereat the contact feature and the contact pad are disengaged through a second position whereat the contact feature and the contact pad are initially engaged at a first location to a third position compressing said resilient means toward said female member, said male and said female surfaces being angularly disposed relative to the direction of movement of said male member whereby the contact feature is wiped across the contact pad from a first location to a second location spaced from the first location as said male member moves from said second position to said third position, said resilient means including an elastomeric pad received in the cavity having an outer surface normally lying in a first plane generally parallel to said female surface but spaced therefrom in the direction of said male member, said elastomeric pad underlying the raised contact feature on the second flex circuit, said outer surface being movable to a second plane coplanar with said female surface when said male member is moved to said third position.

13. An electrical connection assembly comprising:

a first flex circuit having at least one contact pad thereon;

a second flex circuit having at least one raised contact feature thereon engageable with said contact pad;

a female member including a female surface for supporting said second flex circuit thereon, said female surface having a cavity therein;

resilient means on said female member underlying said second flex circuit and biasing said raised contact feature away from said female member;

a male member including a male surface for supporting said first flex circuit thereon, said male and female surfaces lying in substantially parallel planes, said male member being movable on said female member in a forward direction from a first position whereat said contact feature and said contact pad are disengaged through a second position whereat said contact feature and said contact pad are initially engaged at a first location to a third position compressing said resilient means toward said female member, said male and said female surfaces being angularly disposed relative to the direction of movement of said male member whereby said contact feature is wiped across said contact pad from the first location to a second location spaced from the first location as said male member moves from said second position to said third position, said resilient means including an elastomeric pad received in the cavity having an outer surface normally lying in a first plane generally parallel to said female surface but spaced therefrom in the direction of said male member, said elastomeric pad underlying the raised contact feature on the second flex circuit, said outer surface being movable to a second plane coplanar with said female surface when said male member is moved to said third position.

* * * * *